US005263633A

United States Patent [19]

Bicksler, III et al.

[11] Patent Number: 5,263,633

[45] Date of Patent: Nov. 23, 1993

[54] DISPLAY CARTON AND BLANK THEREFOR

[75] Inventors: William B. Bicksler, III, Clinton; Billy R. Stroud, Camanche, both of Iowa

[73] Assignee: Waldorf Corporation, St. Paul, Minn.

[21] Appl. No.: 849,172

[22] Filed: Mar. 10, 1992

[51] Int. Cl.[5] ..... B65D 5/00

[52] U.S. Cl. ..... 229/109; 229/40; 229/87.08; 229/933; 206/548; 206/491

[58] Field of Search ..... 206/491, 541, 548; 229/40, 87.08, 109, 110, 112, DIG. 9

[56] References Cited

U.S. PATENT DOCUMENTS 1,112,642 10/1914 Morgenstern .
2,174,687 10/1939 Comley .
2,320,665 6/1943 Shearer .
2,706,592 4/1955 Schaller .
2,795,365 6/1957 Currie .
2,925,213 2/1960 Zukoski .
2,963,215 12/1960 Saidel et al. .
2,965,283 12/1960 Dunning .
2,987,176 6/1961 Ringler .
3,096,880 7/1963 Farquhar ..... 229/40
3,511,432 5/1970 Gish ..... 229/40
3,633,815 1/1972 Rosenburg, Jr. .
3,722,783 3/1973 Rous ..... 229/40
4,869,368 9/1989 Hara ..... 206/491
5,004,104 4/1991 Saulas .
5,119,940 6/1992 Grindrod ..... 229/87.08

*Primary Examiner*—David T. Fidei
*Attorney, Agent, or Firm*—Dorsey & Whitney

[57] ABSTRACT

In accordance with the present invention, a carton for consumer goods, specifically food items, is provided. The carton is a generally tubular, sleeve-type seal-end display carton having opposed parallel polygonal main panels. End closure flaps and left and right side closure flaps are foldably connected to the main panels. The carton, and the blank from which the carbon is formed, is modified to expose corner areas of the contents and to allow nesting of the blanks when the blanks are laid out on a sheet of stock paperboard material.

18 Claims, 6 Drawing Sheets 120
122
92
124
46
66
70
d
68
82
14
40
38
48
76
18
36
16
e
f
g
h

DISPLAY CARTON AND BLANK THEREFOR

The present invention relates to seal-end display cartons. More particularly, the present invention relates to a seal-end carton, and the blank for the carton, that is modified to allow nearly complete nesting of the blanks on the stock material from which they are formed.

BACKGROUND OF THE INVENTION

In recent years, there has been increased recognition of the need to conserve natural resources. Thus, there is pressure upon the paper and paperboard carton industries to increase the efficient use of stock material. At the same time, rising prices are also driving the quest for efficiency and economy. These demands, as well as the need to provide attractive, commercially interesting packaging for consumer goods, including food items, have created the need for a simple, attractive recyclable or disposable container for packaging consumer goods that can be cost efficiently manufactured.

It is well known in the prior art to use paperboard cartons in various forms to package and display consumer items, with specific regard to food items. A number of cartons have been used wherein a portion of the food item may be viewed through an opening or openings in one or more of the carton walls. For example, one commercially available carton has openings in one of the large side walls, as well as in portions of the side or end walls. Such cartons may be provided with an overwrap material or used with inter-packaged items.

Although commercially available display cartons, and methods of forming the cartons, for packaging various items have improved, there are some problems which have remained unaddressed. One such problem is providing a carton and blank therefor which minimizes the use of valuable resources. Another, somewhat contradictory, problem or goal is that for packaging certain items, for example, food items, the food items must be maintained in as clean condition as possible during shipment, after arrival and before use. Handling and storing packaged food items after their arrival at the point of sale is common. It is highly desirable that a package be strong enough to adequately protect the contents, yet attractively display the contents for potential consumers. With current packaging methods, stability, efficiency and safety are not enhanced to an optimum degree.

U.S. Pat. Nos. 2,706,592 (to Schaller), 2,174,687 (to Comley), and 2,320,665 (to Shearer) cartons or packaging for containing food items or other goods. The cartons are generally octagonally shaped and include cutouts or inspection openings for viewing or displaying at least a portion of the contents. The patent to Schaller is not directed to containing food items, but does disclose a carton wherein two sides of the carton are linked by common flap and the full size overlapping flaps are joined to form the ends or closed width of the carton. The Schaller carton includes a knocked-out part.

None of the cartons disclosed in the above three patents is intended to display the corners or sides of the contents. More importantly, there is no suggestion in any of the three patents, nor in commercially available cartons which do display corner or side areas of products contained therein, about how to provide a blank for forming the cartons wherein the blank is nestable to reduce the consumption of paperboard stock.

U.S. Pat. Nos. 2,795,365 (to Currie), 2,987,176 (to Ringler) and 5,004,104 (to Saulas) are directed to reducing the use of paperboard stock material by using nestable blanks. The Ringler patent is directed to providing a can carrier that displays the contents. FIG. 11 of the Ringler patent shows the manner in which adjacent blanks may be patterned on a stock sheet with a minimum waste of the sheet material. The pattern includes particular relationships among the side panels and end and wing panels to conform the package to the contents and to display a portion of the contents. More specifically, the blank patterns are made to interfit by providing short, square-ended end straps, requiring additional die-cutting, rather than by determining the required size of the carton based on the intended contents and the desired amount of exposure of the contents at each corner, and then establishing a simple angular relationship to maximize nesting of the blanks and simplify the die-cutting process.

The patent to Saulas discloses at least a pair of nested blanks (see FIG. 2). The nesting is facilitated by "waisted" top and bottom wall panels. The end wall panel fit in complementary recesses defined by the end edges of the top and bottom wall panels by virtue of their shape. Corner parts nest also into the recesses and the end closure panels of one blank can be fully nested with those of an adjacent blank. The recesses are "sized and positioned to correspond" to the corner portions, but a specific method of sizing and positioning is not taught. The patent to Currie discloses a carton and a method of cutting blanks from stock sheet material that is somewhat similar to that disclosed in the Saulus patent.

None of the above noted patents explicitly discloses a seal-end display carton and a method for determining and relating the dimensional parameters of the carton in such a way that a carton of a desired size may be formed, yet wherein multiple blanks for forming the cartons may be nested to minimize waste of valuable paperboard. Additionally, none of the above noted patents discloses a carton structure wherein portions of the front and back panels, major side closure flaps and end closure flaps are removed to provide a generally polygonal seal-end display carton having open areas or open corners to display the contents, yet adequately protect the contents during shipment, handling and storage at the point of sale or use. Accordingly, there is a need for a simple, safe, cost efficient, strong yet disposable seal-end display carton for containing consumer goods, particularly food items.

SUMMARY OF THE INVENTION

In accordance with the present invention, a carton for consumer goods, particularly food items, is provided. The carton comprises a generally tubular, sleeve-type seal-end display carton having opposed parallel polygonal main and back panels. Minor top and bottom end closure flaps and major left and right side trapezoidal closure flaps are foldably connected to the edges of the front and back panels. The carton, and the blank from which the carton is formed, is beveled to expose the corner areas of the contents and to allow substantially complete nesting or immediately adjacent contacting relationship between adjacent blanks when many blanks are laid out on a sheet of stock paperboard material prior to die-cutting.

The modification and complete nesting are provided because the outside edge of each major left and right side closure flap has the same dimension as the width of the carton between the front and back side panels of the erected carton. To form a blank for the carton which will provide this feature, the desired carton width or size is determined, and a straight line, angled from the vertical and horizontal at a selected angle, is drawn between a given point (e.g., the center) of the score line connecting the bottom end closure flap to the front and rear wall panels, and any selected points (e.g., the corners) of the outside edge of each of said major side closure flaps. Cutting through the stock along the angled lines creates bilateral trapezoids from what would otherwise be typical, generally rectangular front, rear and side panels. Each trapezoid comprises a trapezoidal side closure flap foldably connected to a main side panel along its base and a rectangular portion of the associated main front or rear panel. A blank die-cut in this pattern or fashion will be completely nestable with another similar blank and will be foldably erectable to form a seal-end display carton wherein the four typical carton corners are cut-off or open along a portion of the sides and ends of the carton.

A feature of the blank of the present invention is two trapezoidal areas formed on each side of blank with a complementary relieved area between them. If straight, angled lines collinear with the sides of one such blank are extended from one row of such blanks arranged end-to-end, another row of identical blanks can be formed immediately adjacent to the first row. The two rows of blanks are staggered longitudinally with respect to each other by approximately half of the length of a single blank, and two or more rows of the blanks nest completely with little or no scrap-producing space between adjacent rows of blanks. The present invention encompasses alternative embodiments wherein the sides of the blank have shapes other than trapezoidal, for example, triangular.

One object of the present invention is to provide a sleeve-type, seal-end display carton for consumer goods.

Another object of the present invention is to provide a package for consumer goods, specifically food items, whereby, during shipping, damage to the contents of the package is minimized.

Yet another object of the present invention is to provide a display carton, wherein a portion of the contents, specifically at least the corner areas thereof, are displayed to potential purchasers, yet the contents are adequately protected during shipment and at the point of sale.

A further object of the present invention is to provide a simple, cost efficient paperboard carton for containing a plurality of food items whereby the carton protects the food items during a shipment, yet displays the food items to prospective customers at the point of sale, and wherein manufacturing and gluing operations typically used for standard sleeve-type, seal-end cartons may be used to form the carton.

Yet another object of the present invention is to provide a seal-end, display carton whereby the blank for the carton has a configuration that allows many blanks to be nested whereby many more cartons or blanks for forming the cartons can be printed on, and die-cut from, a given sheet size of stock material.

An important advantage of the present invention is that it combines specific shipping and packaging advantages such as cost efficient production and adequate protection of contents with specific point of sale and use advantages such as enhanced durability, attractive display, and easy opening.

Other advantages of the present invention are that it can be used with suitable supplemental packaging means such as thermoplastic shrink wrap or other wrappings either inside or outside the carton walls.

Even though the package or carton of the present invention adequately protects consumer goods during storage or handling, it provides for easy opening at the point of use. The carton of the present invention, particularly the blank therefor, may be adapted easily to reconfigure a carton to accommodate different consumer goods and different sizes of the same consumer goods. Additionally, the carton of the present invention can be used for products which are generally solid or for products which are contained in trays or inter-packaged in any way.

Other objects and advantages of the present invention will become more fully apparent and understood with reference to the following specification and to the appended drawings and claims.

DETAILED DESCRIPTION OF THE PREFERRED EMBODIMENT

Figure 1:
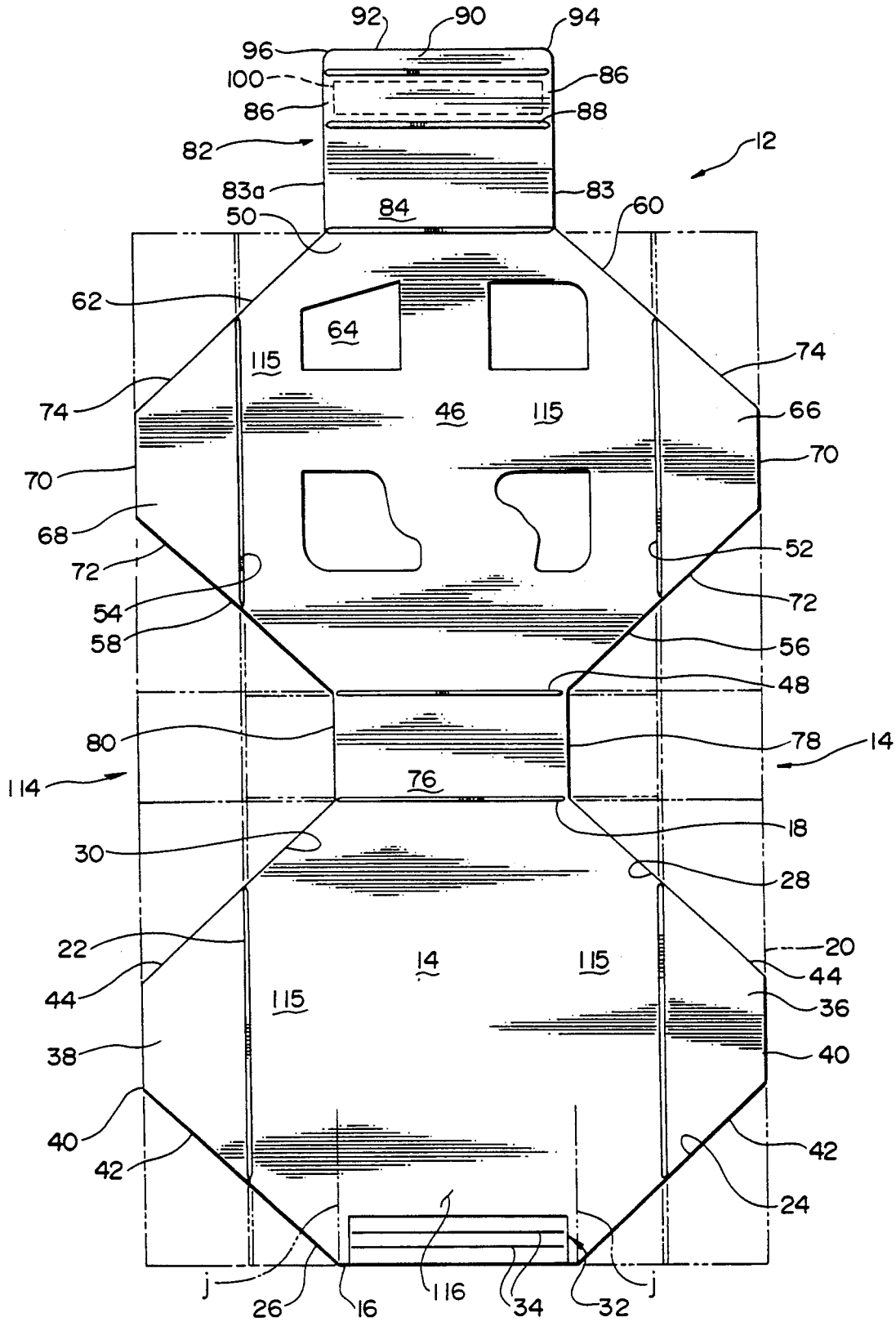
FIG. 1 is a plan view of the blank from which the display carton of the present invention may be formed and depicts the die-cut profile thereof.

As shown in FIG. 1, a blank 12 in accordance with the present invention is formed by a predetermined pattern of fold score lines and cuts, scores and free edges. In the drawings, double lines indicate fold lines and single solid lines indicate cuts, scores, or free edges. Additionally, FIG. 1 depicts a representative generally rectangular prior art sleeve-type, seal-end carton in phantom.

The blank 12 has a first octagonal bottom wall panel 14 formed and defined by free end cut edge 16 and fold score lines 18, 20, 22. The edge 16 and end fold line 18 are opposed and parallel with respect to each other, and are generally perpendicular to the parallel side edge fold lines 20, 22. The octagonal periphery of the bottom wall panel 14 comprises a plurality of relatively short, straight angularly related intersecting segments and is completed by free cut edges 24, 26, 28, 30 formed by straight angled cuts extending from the free end edge 16 to the side fold score lines 20, 22 and from the end fold line 18 to the side fold lines 20, 22, respectively. The cut edges 24, 30 form two opposed corner edges of the panel 14, and the cut edges 26, 28 form another two opposed corner edges of the panel 14. The outside of the bottom panel 14 includes a partial incision pattern 32 immediately adjacent to the free end edge 16. The pattern 32 is formed by a plurality of generally superficial, parallel partial incisions or cuts 34.

Two lower, opposed major side wall closure flaps 36, 38 are hingedly connected at their bases to the bottom wall panel 14 along the side fold lines 20, 22, respectively. The side wall closure flaps 36, 38 are generally trapezoidal and substantially identical, each having a free outermost cut apex edge 40 parallel to the fold lines 20, 22 and two angled free edges 42, 44 extending from the ends of the free edge 40 to the corners of the bottom wall panel 14 formed by the intersection of the fold lines 20, 22 and the edges 24, 26, 28, 30. The angled edges 42, 44 of the side wall closure flaps 36, 38 are substantially collinear with the bottom wall panel edges 24, 26, 28, 30.

With continued reference to FIG. 1, the blank 12 has a second octagonal top cover wall panel 46 formed and defined by four fold score lines including two opposed parallel end fold score lines 48, 50 and two opposed parallel side fold score lines 52, 54. The two sets of edge forming fold score lines are orthogonal with respect to each other. The octagonal periphery of the top wall panel 46, formed by eight segments, is completed by corner edge forming free cut edges 56, 58, 60, 62 (edges 56, 62 are opposed to each other, as are edges 58, 60) formed by straight angled cuts extending from the ends of the fold score line 48 to the side fold score lines 52, 54 and from the ends of the fold line 50 to the side fold lines 52, 54, respectively. If the main bottom wall panel 14 and main top wall panel 46 are superimposed, their peripheries correspond, or are congruent. The top panel 46 includes a plurality of product viewing display openings or windows 64. Four windows 64 are shown, but any number may be provided in any arrangement and shape, as long as the strength and integrity of the carton formed from the blank 12 is not comprised.

Two upper, opposed major side wall closure flaps 66, 68 are hingedly connected to the top wall panel 46 at their bases along the side fold lines 52, 54, respectively. The side wall closure flaps 66, 68 are generally trapezoidal and substantially identical, each having a free outermost cut apex edge 70 parallel to the fold lines 52, 54 and two angled free edges 72, 74 extending from the ends of the free edge 70 to the corners of the top wall panel 46 formed by the intersection of the fold lines 52, 54 and the edges 56, 58, 60, 62. The angled edges 72, 74 of the side wall closure flaps 66, 68 are substantially collinear with the top wall panel edges 56, 58, 60, 62.

The bottom wall panel 14 and top wall panel 46 are hingedly connected to each other by being hingedly connected to a relatively small, generally rectangular rear end closure panel 76 along end segment fold lines 18, 48, respectively. The rear end panel 76 is further formed and defined by parallel free side edges 78, 80. The side edges 76, 80 are generally perpendicular to the fold lines 18, 48 forming the other edges of the rear panel 76.

A seal-end closure flap arrangement 82 is hingedly connected to the top wall panel 46 along one end segment of the top wall panel periphery, specifically at the end edge fold line 50. The closure flap arrangement 82 includes a generally rectangular end wall forming closure flap 84 hingedly or foldably connected directly to the top wall panel 46 at fold line 50. An intermediate closure flap 86 is foldably connected to the end wall closure flap 84 along a fold line 88 parallel to the fold line 50. The intermediate flap 86 is generally rectangular, and is relatively smaller than the end wall closure flap 84. A generally rectangular pull tab 90 having a free edge 92 and rounded free corners 94, 96 is hingedly connected to the intermediate flap 86 along a fold line 98 parallel to the fold line 88 between the end wall closure flap 84 and the intermediate closure flap 86. An suitable adhesive or gluing area 100 may be provided on the inside of the intermediate flap 86. Other suitable closure structure (not depicted, but well known) might be used in lieu of the closure flap arrangement 82. For example, the arrangement 82 could be split into portions connected to each of the main panels 14, 46, the portions being designed to be interconnected by interlocking tabs, tab/slit arrangements, or other suitable mechanical means.

Figure 2:
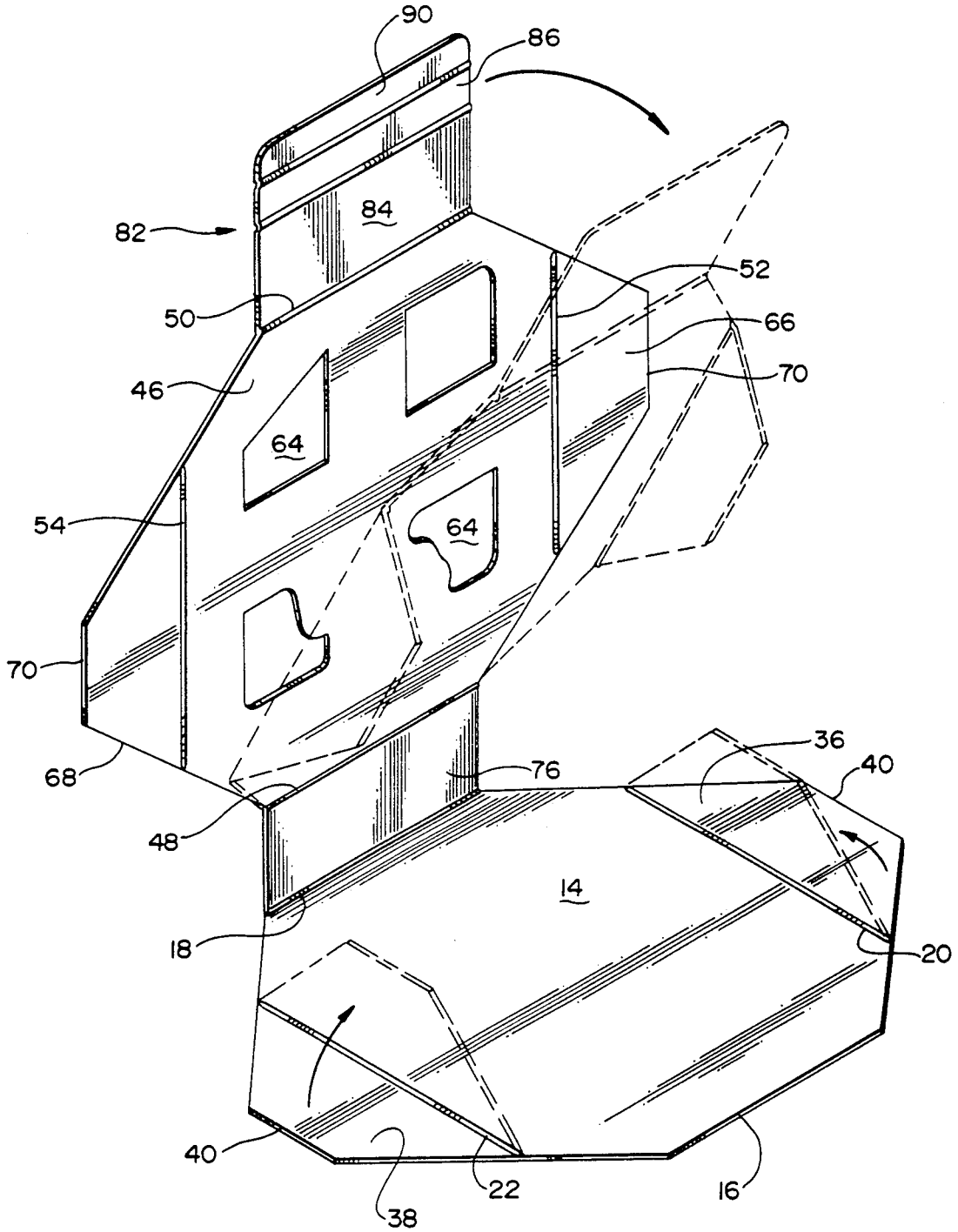
FIG. 2 is a perspective view of the blank of the present invention depicting an initial step in the foldable erection thereof.
Figure 3:
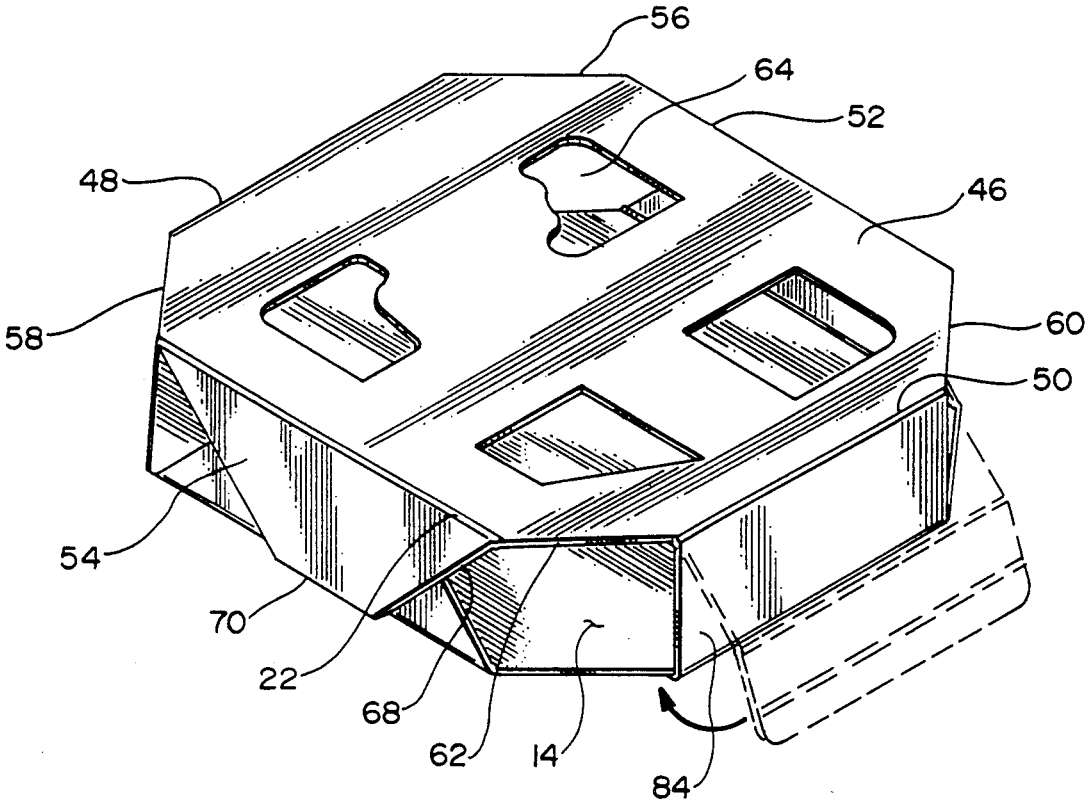
FIG. 3 is a perspective view of the present invention depicting a subsequent step in the foldable creation of the carton of the present invention, the carton being completely formed and closed when the depicted step is completed.

FIG. 2 depicts initial and subsequent steps in foldably erecting the blank 12 into the carton 110 of the present invention (depicted fully formed and ready for sealing in FIG. 3). Early in the process of erecting the blank 12, the rear panel 76 and top wall panel 46 are folded upwardly about the fold line 18 joining the rear panel 76 and the bottom panel 14 until the rear panel 76 is generally perpendicular to the bottom wall panel 14. At the same time, or as a subsequent step or steps, the lower, trapezoidal side wall closure flaps 36, 38 are folded upwardly about fold lines 20, 22, respectively, until they are substantially perpendicular to the bottom wall panel 14. Next, as depicted in phantom, the top wall panel 46 is folded downwardly about the fold line 48 joining the rear panel 76 and the top wall panel 46 until it is substantially parallel to the bottom wall panel 14. The upper side wall closure flaps 66, 68 connected to the top wall panel 46 are then folded downwardly until they are outside and closely adjacent and parallel to the lower side wall closure flaps 36, 38, respectively, connected to the bottom wall panel 14, in which position they can be secured to the lower flaps 36, 38 by appropriate means. The blank 12 will now be in the configuration depicted in FIG. 3, wherein the carton 110 of the present invention is ready to be filled with its intended contents (not shown).

With reference to FIG. 3, after filling, the carton 110 is sealed by folding the closure flap arrangement 82 downwardly about the fold line 50 joining it to the top wall panel 46 until the end wall forming closure flap 84 is generally perpendicular to the bottom wall panel 14 and parallel to the rear panel 76. Next, the intermediate closure flap 86 is folded about the fold line 88 until it closely overlies the incision pattern 32 on the outside of the bottom wall panel 14, where it is adhered by appropriate means. The pull tab 90 is not adhered to the bottom wall panel 14, being free to grasp and pull during the opening of the carton 110.

The present invention encompasses an unique method of laying out the blank 12 for die-cutting to facilitate minimizing the use of stock material as will be explained with reference to FIG. 4. The method comprises the steps of determining or selecting the appropriate width or depth of the carton 110 based on the intended contents or use. This dimension will be the length of the outermost free apex edge 40, 70 of the side closure flaps 36, 38 and 66, 68, respectively, and is represented by "d" in FIG. 4. Next, a first set of straight parallel lines "e", angled from both horizontal and vertical and spaced apart by the dimension "d", is drawn through the end points of the generally vertical line having dimension "d" and selected points, in this instance the center points, of generally horizontal lines that will become the fold lines 18, 48. A second set of parallel lines "f", also spaced apart by the distance "d", is plotted or drawn through the same points along the lines 18, 48 at angle complimentary to the angle of the first set of lines "e". Next, parallel vertical lines, such as lines "g" and "h", are drawn through the angled line sets "e", "f". The distance separating the vertical lines is variable, being predetermined by the size of the intended contents, and is reflected in the sum of the dimension "d" and one-half of the width of the main top and bottom wall panels 14, 46, respectively. Continuing the process of plotting the parallel angled lines similar to line sets "e", "f" and the vertical lines "g", "h", creating a diamond matrix, and then connecting them with shorter perpendicular, in this instance horizontal, lines for forming the end edges 16, 92 and fold lines 50, 88, 98 enables the outlining of a blank 12 for die-cutting.

One of the advantages of the carton of the present invention may be appreciated by examining FIGS. 1 and 3. FIG. 1 depicts the generally hourglass peripheral shape of the blank 12 for forming the carton 110 of the present invention. When foldably erected, the blank 12 forms a carton 110 having generally rectangular openings 112 at each corner as shown in FIG. 3. The openings 112 are at an angle across what would be the corners of a typical rectangular seal-end carton and are formed and defined by the two angled cut lines comprised of edges 28, 44 and 30, 44 associated with the bottom wall panel 14 and the lower side closure flaps 36, 38, the two angled cut lines comprised of edges 56, 72 and 58, 74 associated with the top wall panel 46 and the upper side closure flaps 66, 68, the straight end edges 78, 80 of the rear panel 76, and the straight edges 83, 83*a* of the enclosure flap 84. The amount of product or contents exposure at the corner of the carton is determined by the interrelated combination of the angle of the lines of the type "e", "f" and the dimension "d" used in laying out an individual blank 12.

As shown in FIG. 1, the cut edge lines which form the generally central portion of the relatively long lateral or side portions of the periphery of the blank 12 define a generally trapezoidal relieved area 114 at each side of the blank 12. This relieved area 114 is substantially exactly complimentary to a trapezoidal area 115 comprised of each side closure flap 36, 38, 66, 68 and an adjacent rectangular portion of its associated main top and bottom wall panel 46, 14. The base 116 of this complimentary trapezoidal area 115 is shown at line "j". The relieved area 114 is particularly apparent by contrasting the die-cut outline of the blank 12 of the present invention with a outline of a representative, typical, generally rectangular sleeve-type carton, depicted in phantom in FIG. 1.

Figure 4:
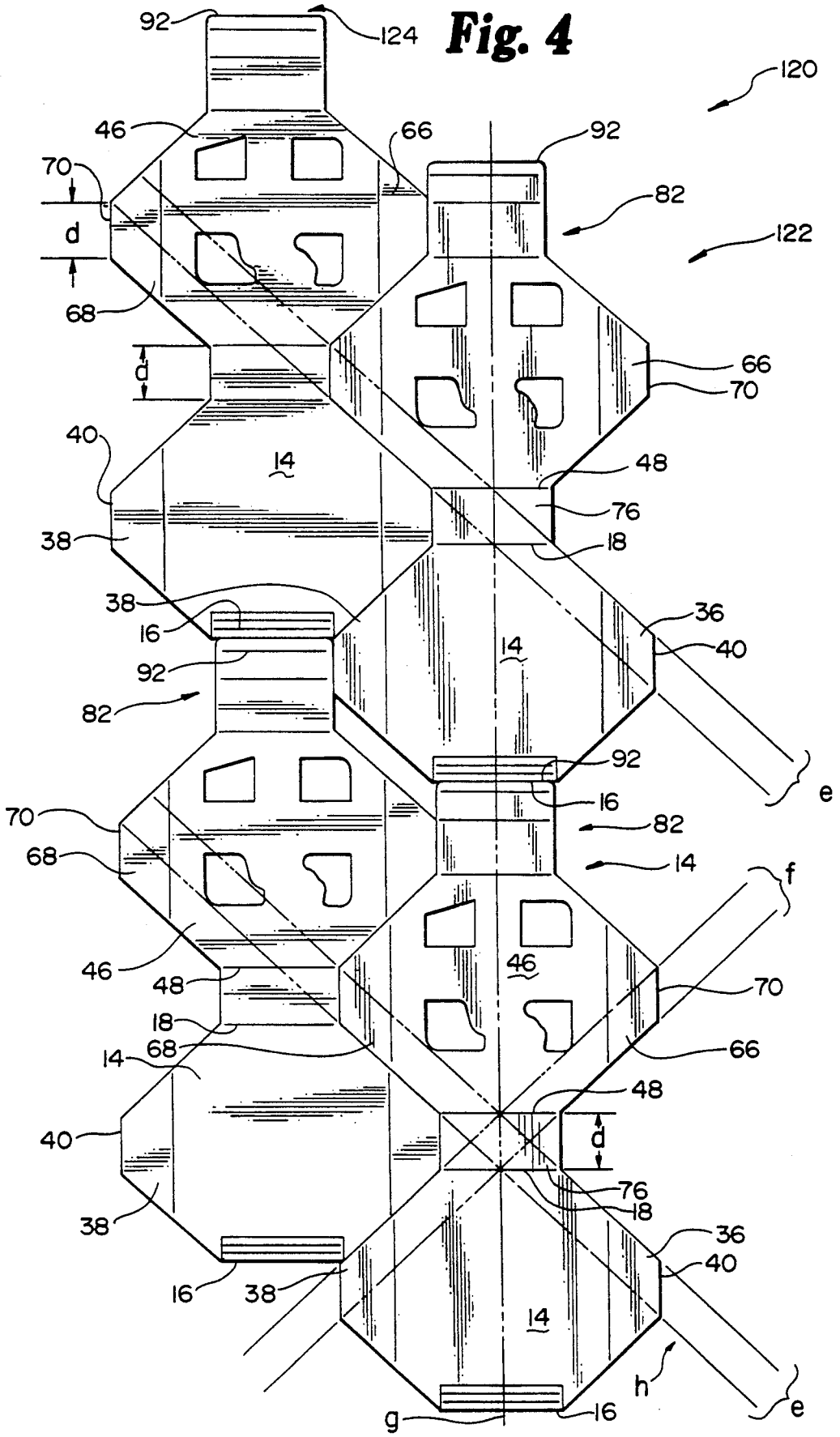
FIG. 4 is a top plan view of a portion of a sheet of stock material depicting the die-cut profile of two rows of nested blanks.

Another important advantage of the present invention is derived from the complimentary trapezoidal areas 114, 115 and is depicted in FIG. 4, showing a pattern 120 of substantially identical blanks 12 laid out on a sheet of stock material for die-cutting therefrom. The pattern 120 comprises a first row 122 of individual blanks 12 laid end-to-end, i.e., with the end edge 16 of the main bottom panel 14 contacting or collinear with the free edge 92 of the pull tab 90. A second row 124 of blanks 12, also laid out end-to-end, is immediately adjacent to the first row 122, whereby the straight angled lines forming a portion of the octagonal periphery of the bottom wall panel 14 are substantially collinear with the straight angled lines forming a portion of the octagonal peripheral edge of the top wall panel 46. It will be observed that the length of the straight end edges 78, 80 of the rear panel 76, the length of the free edges of the closure flap 84, and the length of the outermost free apex edges 40, 70 of the side closure flaps 36, 38 and 66, 68, respectively, are substantially identical. Thus, the saw-tooth shape of the sides of the blank 12 for forming the carton 110 of the present invention enables the complete or nearly complete nesting of multiple blanks 12, whereby there is little or no waste of superfluous stock material between the blanks 12. This method of creating a pattern of blanks 12, is enabled by extending the angled lines "e", "f", carrying them from the first row 122 of blanks 12 into what will become the next row 124, and then repeating the method for forming the blank 12 as set forth above. Although only rows 122, 124 are shown, many nested rows of blanks 12 can be formed.

Figure 5:
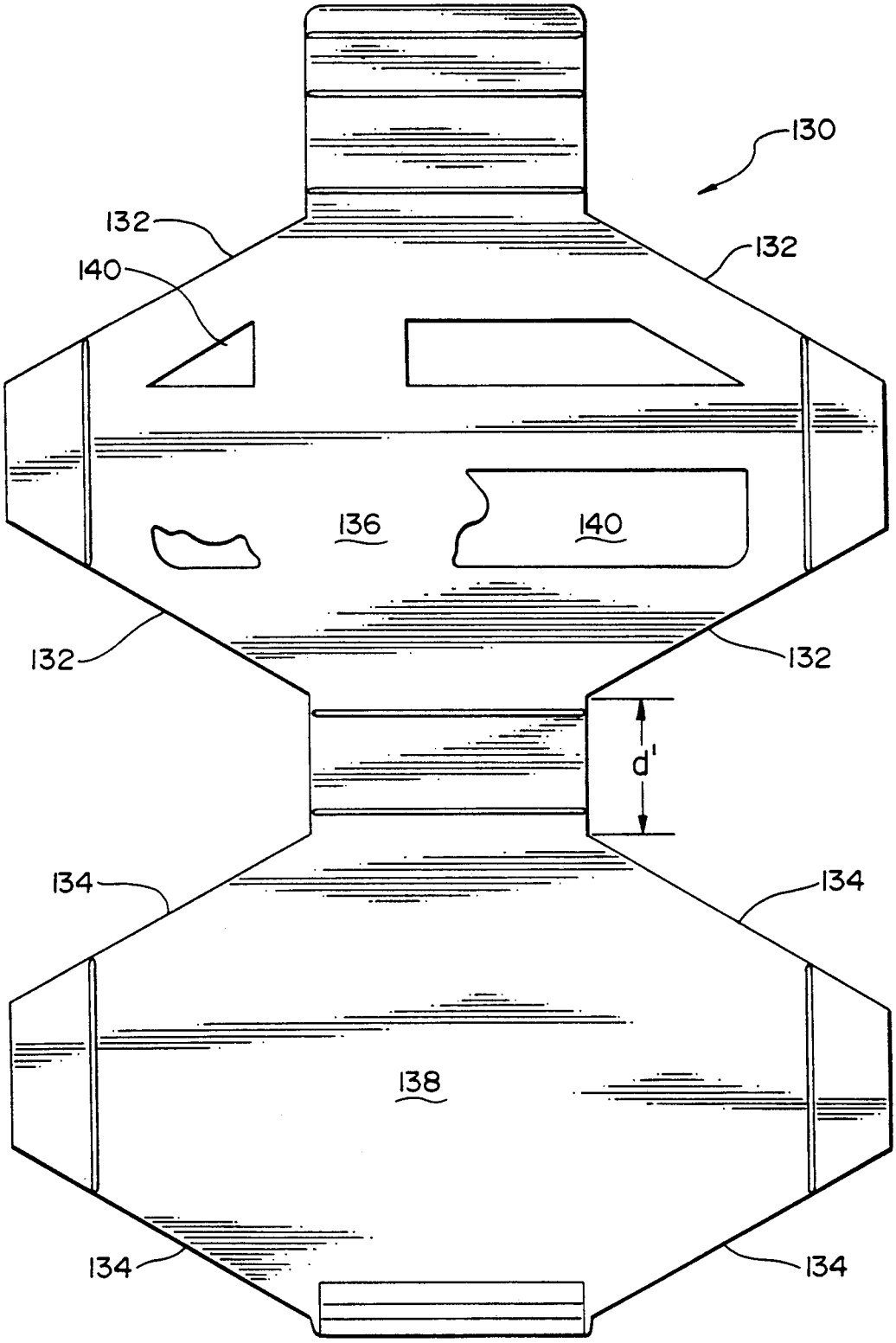
FIG. 5 is a plan view depicting the inside of a second embodiment of the blank for forming a second embodiment of the carton of the present invention.

FIG. 5 depicts a blank 130 for forming a second embodiment of the present invention. The blank 130 has essentially the same structural and operational features as the blank 12 and is laid-out for die-cutting by essentially the same method. It should be appreciated easily, however, that the amount of contents or product display at the corners of the carton enabled by the blank 130 is different than that enabled by the blank 12 because the dimension "d" representing the depth of the carton and/or the thickness of the contents, has been made larger than dimension "d". Likewise, the angle of the angled lines 132, 134 forming a portion of the periphery of the main top and bottom wall panels 136, 138, respectively, has been adjusted more closely to horizontal. Additionally, the size, shape and location of the windows 140 in the top and bottom side wall panels 136, 138 is different relative to the windows 64 depicted in FIG. 1. As with the blank 12, many blanks 130 can be formed in adjacent, nested rows by following the method set forth above.

Figure 6:
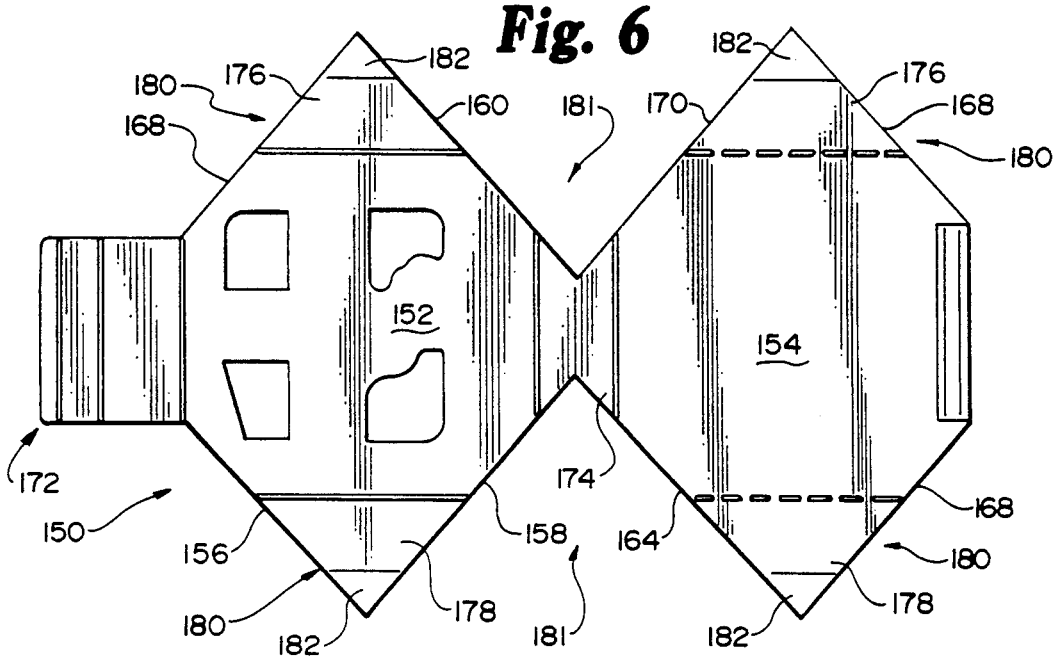
FIG. 6 is a plan view depicting the outside of a third embodiment of the blank for forming a third embodiment of the carton of the present invention.
Figure 7:
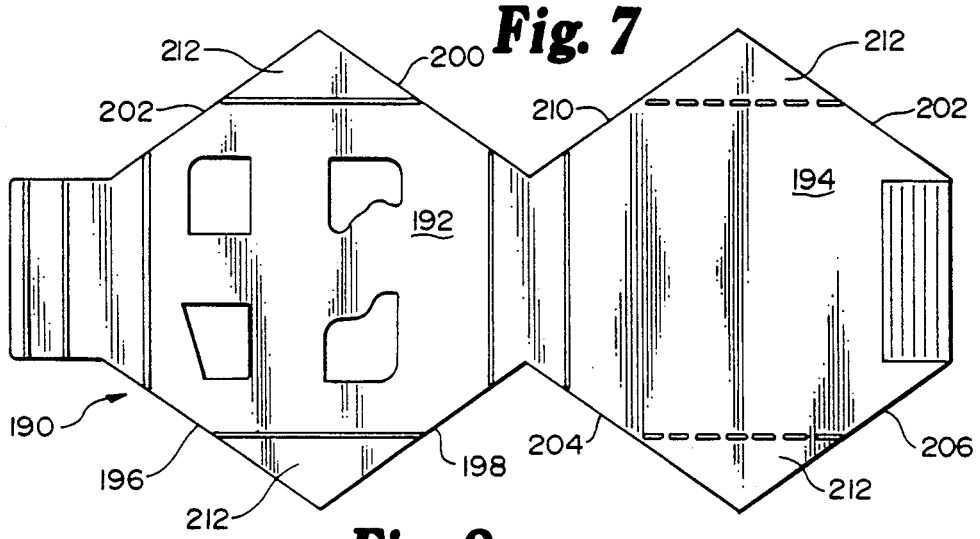
FIG. 7 is a plan view depicting the outside of a fourth embodiment of the blank for forming a fourth embodiment of the carton of the present invention.
Figure 8:
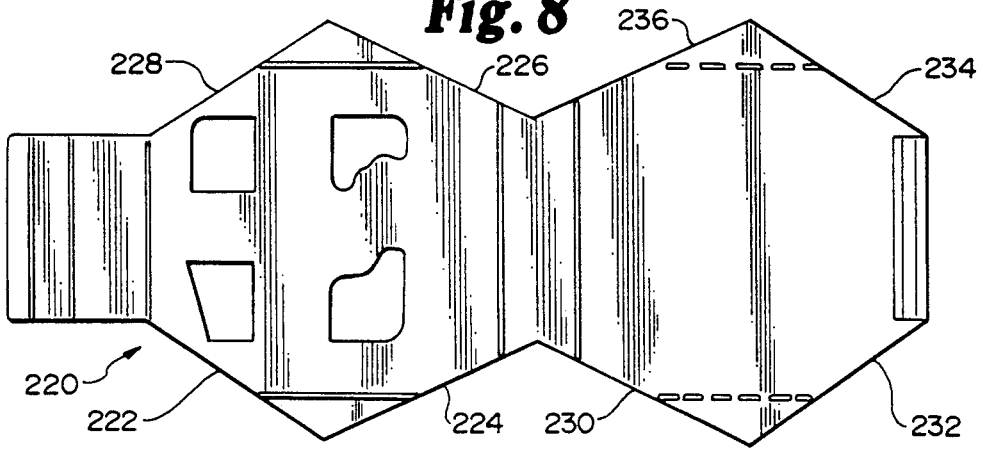
FIG. 8 is a plan view depicting the outside of a fifth embodiment of the blank for forming a fifth embodiment of the carton of the present invention.

FIGS. 6–8 depict blanks for forming additional embodiments of the present invention. The blanks shown in FIG. 6–8 have essentially similar structural and operational features as the blank 12 and are laid-out for die-cutting by essentially the same method.

The blank 150 depicted in FIG. 6 includes two generally diamond-shaped main panels 152, 154. The panels 152, 154 are formed substantially by side edges 156, 158, 160, 162 and 164, 166, 168, 170, respectively. An end closure flap assembly 172 is hingedly joined to one of the main panels 152, 154, in this instance panel 152, and the main panels are joined by a rear end wall 174. A pair of generally triangular side closure flaps 176, 178 is foldably connected to each main panel 152, 154, each main panel thereby having an apex area 180. A generally triangular relieved area 181, complimentary to the apex area 180, is formed at the sides of the blank 150. After blank 150 is die-cut from the stock material, a tip portion 182 of the apex area 180 can be removed to form a trapezoidal side closure flap 176, 178. Alternatively, the tip 182 can be used for gluing and/or reinforcement.

FIG. 7 depicts a blank 190, including main panels 192, 194, that is substantially similar to the blank 150. However the angle of the edges 196, 198, 200, 202 and 204, 206, 208, 210, forming the main panels 192, 194, respectively, has been changed to form triangular closure flaps 212 hingedly connected to the main panels 192, 194 and to change the amount and location of contents exposure. Likewise, for forming the blank 220 depicted in FIG. 8, the angle of the edges 222, 224, 226, 228 and 230, 232, 234, 236 has been adjusted to change the shape of the open areas (not shown, but similar to openings 112) that will be formed when the blank 220 is folded into a carton. As with blank 12, many of blanks 150, 190 or 220 can be formed in nested, adjacent rows by following the method set forth above.

A number of variations of the present invention can be accomplished within the scope of the invention. For example, the location, size and shape of the windows 64 or 140 may be varied as desired. The carton 110 can be adapted to contain products of various sizes and shapes. Portions of the carton 110 may be curved rather than angled, for example, one or more of the angled portions of the polygonal main top and bottom wall panels could be curved or rounded, as could the window edges. The carton may be formed of any caliper of paperboard or other stock material, be printed with desired graphics or indicia, and may be provided with desired characteristics such as resistance to moisture by applying appropriate coatings.

Although a description of the preferred embodiment has been presented, it is contemplated that various changes, including those mentioned above, could be made without deviating from the spirit of the present invention. It is therefore desired that the present embodiment be considered in all respects as illustrative, not restrictive, and that reference by made to the appended claims rather than to the foregoing description to indicate the scope of the invention.

What is claimed and desired to be protected by Letters Patent is:

1. A display carton comprising:

two polygonal main wall panels, each having a periphery comprised of angularly related, straight line segments of equal length;

a first pair of side closure flaps for partially closing a side of the carton, said first pair of side closure flaps including a closure flap foldably connected to one of said main wall panels and a second closure flap connected to the other said main wall panel, and a second pair of side closure flaps for partially closing another side of the carton, said second pair of side closure flaps including a closure flap foldably connected to one of said main wall panels and a second closure flap connected to the other said main wall panel, each said closure flap is generally trapezoidal, having a base edge and a parallel apex edge, each said closure flap being hingedly connected to one said main wall panel at said base edge, said apex edge being shorter than said base edge;

an end wall panel foldably connected between said main wall panels, said end wall has two parallel free edges, said free edges being generally perpendicular to the foldable connection between said end wall panel and said main wall panels, and the length of said apex edge of each said trapezoidal side closure flaps is substantially equal to the length of said free edges of said end wall panel;

an end closure means for closing the carton whereby said main wall panels are secured in substantially parallel relationship when the carton is closed, said end closure means being foldably connected to one of said main wall panels.

2. The carton according to claim 1, wherein said main wall panels are generally parallel, and wherein said end wall panel is foldably connected to one of said segments of one said main wall panel and to a generally parallel and coplanar segment of the other said main wall panel, said end closure means is hingedly connected to one of said main wall panels along one of said segments, and wherein each of the two trapezoidal side closure flaps comprising each of said pairs of said trapezoidal closure flaps is foldably connected to parallel and coplanar segments of said main wall panels.

3. The carton according to claim 2, wherein said carton has opening for displaying a portion of the contents thereof.

4. The carton according to claim 3, wherein at least a portion of the sides of said carton are open when said carton is closed.

5. A blank for forming a polygonal sleeve-type seal-end display carton, said blank comprising:

two main generally polygonal wall panels each having a periphery;

side closure flaps, each of said polygonal wall panels having two of said side closure flaps foldably connected thereto at opposed fold lines along the respective peripheries of said main wall panels, each of said side closure flaps is generally trapezoidal, having a base edge and a parallel apex edge, each flap being hingedly connected to a said polygonal wall panel at said base edge, said apex edge being shorter than said base edge;

a rear end wall panel foldably connected to both of said polygonal wall panels at a fold line along the respective peripheries of said polygonal wall panels, said rear end wall panel has two parallel free edges, said free edges being generally perpendicular to said fold lines connecting said rear end wall panel to said main wall panels, the length of said apex edge of each of said trapezoidal side closure flaps being substantially equal to the length of said free edges of said rear end wall panel and said fold lines associated with said side closure flaps being generally perpendicular to the fold lines associated with said rear end wall panel;

a closure flap means for closing said carton after said blank is formed into said carton, said closure flap means being foldably connected to one of said polygonal wall panels at a third fold line along the periphery thereof, said third fold line being parallel to said fold line connecting said rear wall panel to the same polygonal wall panel, said closure flap being generally across from said rear end wall panel.

6. The blank according to claim 5, wherein one of said main panels includes display openings.

7. A carton comprising:

two polygonal panels each having a pair of opposing side edges, a pair of opposing end edges and two pairs of opposing corner edges;

a closure flap foldably connected to each of said polygonal panels along each of said side edges, said closure flap is generally trapezoidal, having a base edge and a parallel apex edge, each said closure flap being foldably connected to said polygonal panel at said base edge, said apex edge being shorter than said base edge;

an end wall panel foldably connected between said polygonal panels along one of said end edges of each said polygonal panel, said end wall panel having two parallel free edges, said free edges being generally perpendicular to the foldable connection between said end wall panel and said polygonal panel, the length of said free edges of said end wall panel being substantially equal to the length of said apex edge of each said trapezoidal side closure flaps; and an end closure foldably connected to one of the polygonal panels along the other of said end edges.

8. The carton according to claim 7, wherein the closure flaps connected to said opposing side edges are secured to each other.

9. The carton according to claim 8, wherein said polygonal panels are generally parallel.

10. The carton according to claim 9, wherein said carton has open corners.

11. The carton according to claim 10, wherein said corner edges connect said side edges and end edges:

12. The carton according to claim 11, wherein the length of said side edges is less than the distance between said end edges.

13. The carton according to claim 12, wherein the length of said end edges is less than the distance between said side edges.

14. The carton according to claim 7, wherein said closure flap is generally triangular.

15. A blank for forming a polygonal display carton whereby substantially complete nesting is achieved between adjacent identical blanks, said blank comprising:

two polygonal panels each having a pair of opposing side edges, a pair opposing end edges and two pairs of opposing corner edges;

a closure flap foldably connected to each of said polygonal panels along each of said side edges, said closure flap is generally trapezoidal, having a base edge, a parallel apex edge and two angled free edges, each said closure flap being hingedly connected to a polygonal panel at said base edge, said apex edge being shorter than said base edge;

an end wall panel foldably connected between said polygonal panels along one of said end edges of each polygonal panel, said end wall panel having two parallel free edges, each said end wall panel free edge and said opposing corner edges adjacent said end wall panel free edge having common edges with an apex edge and an angled free edges of a closure flap of an adjacent second blank identical to said blank; and an end closure foldably connected to one of the polygonal panels along the other of said end edges.

16. The blank according to claim 15, wherein said corner edges of each polygonal panel connect said side edges and said end edges of that polygonal panel.

17. The blank according to claim 16, wherein the length of said side edges is less than the distance between said end edges.

18. The blank according to claim 17, wherein the length of said end edges is less than the distance between said edges.

* * * * *